US010449981B2

(12) United States Patent
Kim et al.

(10) Patent No.: US 10,449,981 B2
(45) Date of Patent: Oct. 22, 2019

(54) APPARATUS AND METHOD FOR DYNAMICALLY CONFIGURING WIRELESS SENSOR RELAY NETWORK FOR MONITORING TRAIN ACTIVITY

(71) Applicant: Electronics and Telecommunications Research Institute, Daejeon (KR)

(72) Inventors: Young Il Kim, Daejeon (KR); Dae Geun Park, Daejeon (KR); Geon Min Yeo, Daejeon (KR); Yong Tae Lee, Daejeon (KR); Hyun Woo Lee, Seoul (KR); Sun Hwa Lim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 428 days.

(21) Appl. No.: 15/356,414

(22) Filed: Nov. 18, 2016

(65) Prior Publication Data

US 2017/0137047 A1 May 18, 2017

(30) Foreign Application Priority Data

Nov. 18, 2015 (KR) ..... 10-2015-0162136
Oct. 27, 2016 (KR) ..... 10-2016-0141344

(51) Int. Cl.
*B61L 15/00* (2006.01)
*G07C 5/08* (2006.01)
*B61L 27/00* (2006.01)

(52) U.S. Cl.
CPC ..... *B61L 15/0081* (2013.01); *B61L 15/0027* (2013.01); *B61L 27/0094* (2013.01); *G07C 5/0816* (2013.01)

(58) Field of Classification Search
CPC ..... B61L 15/0081; B61L 15/0027; B61L 27/0094; G07C 5/0816
See application file for complete search history.

(56) References Cited

U.S. PATENT DOCUMENTS 8,989,053 B1 * 3/2015 Skaaksrud ..... H04W 12/06 370/255
8,994,591 B2 * 3/2015 Dupray ..... G01C 21/206 342/457

(Continued)

FOREIGN PATENT DOCUMENTS

KR 10-0860789 B1 9/2008
KR 10-2009-0070883 A 7/2009

(Continued)

*Primary Examiner* — Thomas Ingram

(57) ABSTRACT

An apparatus for dynamically configuring a wireless sensor relay network for monitoring train activity according to the present invention includes a plurality of wireless sensors that wirelessly transmit sensor data obtained by measuring heat and vibration of a train running unit, a plurality of coordinator units that are located in train cars, and receive the sensor data from one or more wireless sensors located within the same train car, a plurality of wireless relay units that are located in the train cars, form a wireless sensor relay network with the wireless relay unit located in a neighboring train car, and transmit the sensor data received from the coordinator units, and a gateway unit that receives the sensor data from the plurality of wireless relay units through the wireless sensor relay network, and transmits the received sensor data to a control center.

17 Claims, 10 Drawing Sheets

(56) References Cited

U.S. PATENT DOCUMENTS

| | | | | |
|---|---|---|---|---|
| 9,419,690 | B2 * | 8/2016 | Okayama | H04W 4/046 |
| 2008/0046955 | A1 * | 2/2008 | Seo | H04H 20/16<br>725/134 |
| 2011/0282540 | A1 * | 11/2011 | Armitage | H04Q 9/00<br>701/31.4 |
| 2014/0336850 | A1 * | 11/2014 | Kim | B61L 15/0027<br>701/19 |
| 2016/0144875 | A1 * | 5/2016 | Kim | B61L 25/026<br>370/328 |

FOREIGN PATENT DOCUMENTS

| | | | |
|---|---|---|---|
| KR | 1020120046955 | A | 5/2012 |
| KR | 10-2014-0133687 | A | 11/2014 |

* cited by examiner

APPARATUS AND METHOD FOR DYNAMICALLY CONFIGURING WIRELESS SENSOR RELAY NETWORK FOR MONITORING TRAIN ACTIVITY

CROSS-REFERENCE TO RELATED APPLICATION(S)

This application claims priority from Korean Patent Application Nos. 10-2015-0162136, filed on Nov. 18, 2015, 10-2016-0141344, filed on Oct. 27, 2016 in the Korean Intellectual Property Office, the disclosure of which is incorporated herein by reference in its entirety.

BACKGROUND

1. Field

The following description relates to a wireless sensor network, and more particular, a low-power wireless sensor network that monitors a train activity state.

2. Description of Related Art

Safety is a very important factor for a train that runs at a high-speed. In order to secure safe running of a train, it is necessary to continuously monitor the condition of the train. More specifically, in order to secure the safe running of a train, the vibration and heat generation state of a running unit should be continuously monitored in real-time. Results obtained by monitoring the vibration and heat generation of the train in real-time are transmitted to a control center or an external control center such as a maintenance center. In addition, when an abnormal condition occurs, the engineer is informed of the occurrence of the abnormal condition, so that safety measures can be taken.

In general, a plurality of sensors for monitoring the vibration and heat generation state of a running unit of a train may be operated as a low-power sensor network, and the vibration and heat generation state may be transmitted to an external control center through a wireless communication network. The organization of a train is frequently changed, and a plurality of train cars are not always fixed but are dynamically rearranged. Accordingly, since a sensor network constituted of sensors for monitoring the condition of a train is not a fixed network, the network configuration and routing have to be dynamically processed.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

The following description relates to an apparatus and method for dynamically configuring a wireless sensor relay network for monitoring train activity that enable a wireless sensor relay network and a relay path to be dynamically configured regardless of alternation of a train car to transmit sensor data.

In one general aspect, an apparatus for dynamically configuring a wireless sensor relay network for monitoring train activity includes: a plurality of wireless sensors that wirelessly transmit sensor data obtained by measuring heat and vibration of a train running unit; a plurality of coordinator units that are located in train cars and receive the sensor data from one or more wireless sensors located within the same train car; a plurality of wireless relay units that are located in the train cars, form a wireless sensor relay network with the wireless relay unit located in neighboring train cars, and transmit the sensor data received from the coordinator units; and a gateway unit that receives the sensor data from the plurality of wireless relay units through the wireless sensor relay network, and transmits the received sensor data to a control center.

The plurality of wireless relay units may measure strength of wireless signals of neighboring wireless relay units, and generate a neighbor list. Further, the wireless relay unit located at the same train car as the gateway unit among the plurality of wireless relay units may generate a beacon message, and transmit the generated beacon message to a determined neighboring wireless relay unit. Here, the beacon message may include source car information and information about the number of wireless paths.

The plurality of wireless relay units may update the received beacon message, and relay and transmit the updated beacon message to the neighboring wireless relay unit. At this point, the updated beacon message may include source car information, the number of wireless paths, and path car information.

More specifically, the wireless relay unit that has received the beacon message may update source car information to information of the wireless relay unit itself, add and update the number of wireless paths, and add and update another wireless relay unit connected directly to the wireless relay unit itself to path car information.

A wireless relay unit that fails to receive a response to the transmitted beacon message within a predetermined response waiting time among the plurality of wireless relay units may generate a configuration completion message, and transmit the generated configuration completion message to the previous wireless relay unit. Further, the plurality of wireless relay units that have received the configuration completion message may update destination car information of the received configuration completion message, source car information, and information about the number of wireless paths, and transmit the updated information to the previous wireless relay unit.

The plurality of wireless relay units may incorporate a newly organized train car into the wireless sensor relay network based on the neighbor list.

In another general aspect, a method for dynamically configuring a wireless sensor relay network using the above-described apparatus for dynamically configuring a wireless sensor relay network includes: measuring, by each of a plurality of wireless relay units, strength of wireless signals from neighboring wireless repeaters and generating a neighbor list; generating, by the wireless relay unit located at the same train car with a gateway unit among the plurality of wireless relay units, a beacon message, and transmitting the generated beacon message to a neighboring wireless relay unit; updating, by the plurality of wireless relay units, the received beacon message, and sequentially relaying and transmitting the updated beacon message to the neighboring wireless relay unit; generating, by the plurality of wireless relay units, a configuration completion message when a predetermined response waiting time is exceeded, and transmitting the generated configuration completion message to the previous wireless relay unit; and receiving, by the wireless relay unit located at the same train car with the gateway unit among the plurality of wireless relay units, the configuration completion message, and generating a wireless sensor relay network.

Other features and aspects will be apparent from the following detailed description, the drawings, and the claims.

BRIEF DESCRIPTION OF THE DRAWINGS

Throughout the drawings and the detailed description, unless otherwise described, the same reference numerals will be understood to refer to the same elements, features, and structures. The relative size and depiction of these elements may be exaggerated for clarity, illustration, and convenience.

DETAILED DESCRIPTION

Hereinafter, embodiments of the present invention will be described with reference to the accompanying drawings. The terminology described below is defined considering functions in the present invention and may vary according to a user's or operator's intention or usual practice. Thus, the meanings of the terminology should be interpreted based on the overall context of the present specification.

Figure 1:
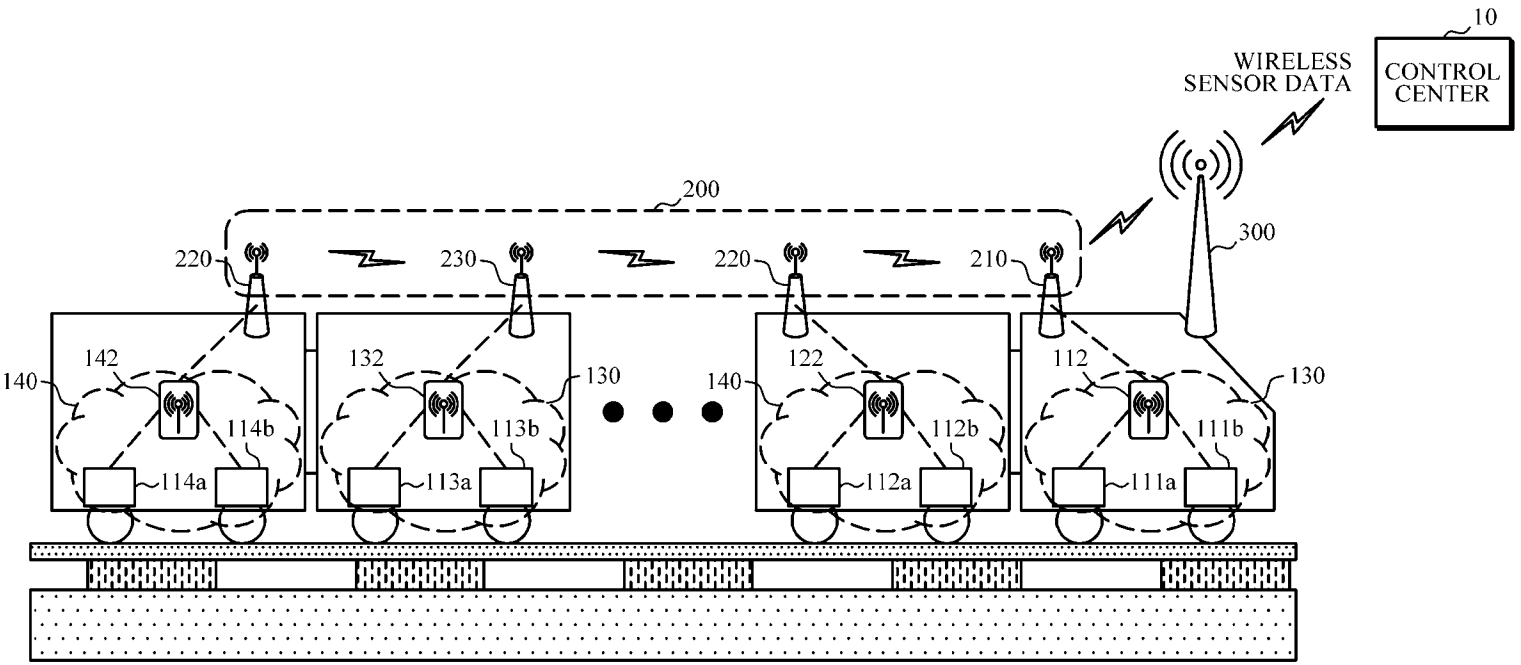
FIG. 1 is a configuration diagram illustrating an example of an apparatus for dynamically configuring a wireless sensor relay network for monitoring train activity according to an embodiment of the present invention.

FIG. 1 is a configuration diagram illustrating an example of an apparatus for dynamically configuring a wireless sensor relay network for monitoring train activity according to an embodiment of the present invention.

Referring to FIG. 1, an apparatus for dynamically configuring a wireless sensor relay network for monitoring train activity according to an embodiment of the present invention includes a plurality of wireless sensors 111*a*, 111*b*, 121*a*, 121*b*, 131*a*, 131*b*, 141*a*, and 141*b*, a plurality of coordinator units 112, 122, 132, and 142, a plurality of wireless relay units 210, 220, 230, and 240, and a gateway unit 300.

The plurality of wireless sensors 111*a*, 111*b*, 121*a*, 121*b*, 131*a*, 131*b*, 141*a*, and 141*b* are sensors capable of measuring temperature and vibration, and generate sensor data by measuring heat and vibration generated in a plurality of bearings on a truck axle of a train. As an example, in the plurality of wireless sensors 111*a*, 111*b*, 121*a*, 121*b*, 131*a*, 131*b*, 141*a*, and 141*b*, a wireless communication interface of an IEEE 802.15.4 method that is a low-power and low-speed short-range wireless communication standard such as Zigbee communication may be used.

The plurality of coordinator units 112, 122, 132, and 142 may form wireless sensor networks 110, 120, 130, and 140 with the plurality of wireless sensors 111*a*, 111*b*, 121*a*, 121*b*, 131*a*, 131*b*, 141*a*, and 141*b* located on the same train car, and receive sensor data.

As an example, a single coordinator unit is located in a single train car, and the corresponding coordinator unit receives sensor data from a wireless sensor located on the same train car. However, the present invention is not limited to a case in which only a single coordinator unit is located within a single train car, and depending on the type/size of the train car and the number and communication situation of wireless sensors, two coordinator units or more may be located within a single train car or a single coordinator unit may be assigned to two train cars or more.

In the example of FIG. 1, the first coordinator unit 112 forms a first wireless sensor network 110 with the first wireless sensor 111*a* and the first wireless sensor 111*b*. Next, the first coordinator unit 112 receives sensor data including information about the temperature and vibration measured by the first wireless sensor 111*a* and the first wireless sensor 111*b* from a train driving unit. The second to fourth coordinator units 120 to 140 also receive sensor data within each train car in the same method.

Since the transmission capacity of the low-power sensor network is limited (for example, a transmission speed of IEEE 802.15.4 is 250 kb/s), a single coordinator unit should be installed in one or two train cars when the transmission capacity is applied to a long train. In this case, since the sensor data collected in the coordinator unit cannot be transmitted directly to the gateway unit 400, it is necessary to relay and transmit the sensor data up to the gateway unit 400 installed in a different train car using a different wireless connection method.

In this manner, since the transmission capacity of the wireless sensor networks 110, 120, 130, and 140 using the coordinator unit is limited, a wireless sensor relay network 200 is configured through the wireless relay units 210, 220, 230, and 240 in order for wireless sensor networks to interwork. As an example, it is desirable that a single wireless relay unit be installed for a single train car. The plurality of wireless relay units 210, 220, 230, and 240 transmit the sensor data received from the neighboring coordinator units 112, 122, 132, and 142 to the gateway unit 300 through the wireless sensor relay network 200.

The gateway unit 300 transmits the sensor data transmitted through the wireless sensor relay network 200 to a control center 10. As an example, the gateway unit 300 may transmit the sensor data to the control center 10 through an Internet network using an external commercial broadband wireless communication network. At this point, the control center 10 may be a control center or an operation maintenance center for managing train operations, or another of various organizations utilizing sensor data.

As described above, the apparatus for dynamically configuring a wireless sensor relay network for monitoring train activity according to an embodiment of the present invention collects sensor data through the wireless sensor network and transmits the collected sensor data to the gateway unit through the wireless sensor relay network, and the gateway unit transmits the sensor data to an external control center.

Figure 2A:
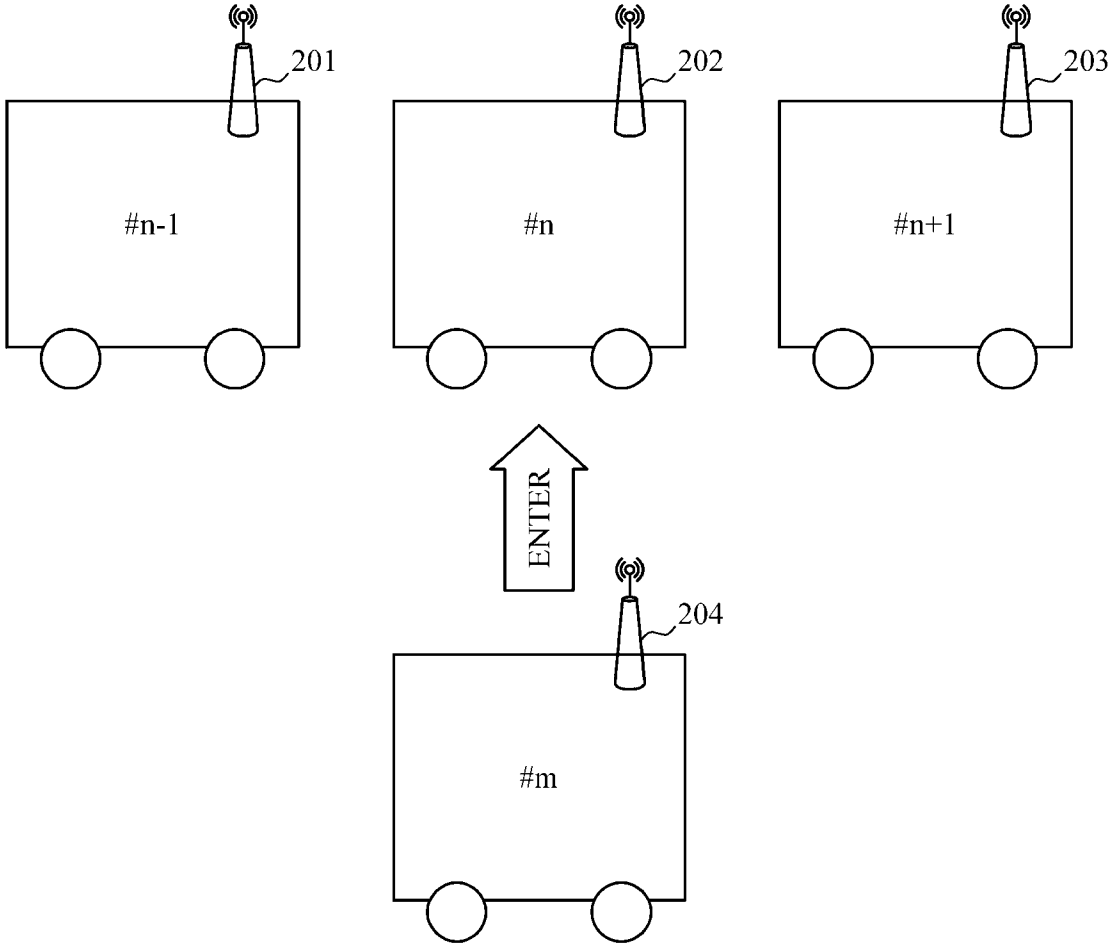
FIGS. 2A to 2C are diagrams illustrating a dynamic configuration process of an apparatus for dynamically configuring a wireless sensor relay network for monitoring train activity according to an embodiment of the present invention.
Figure 2B:
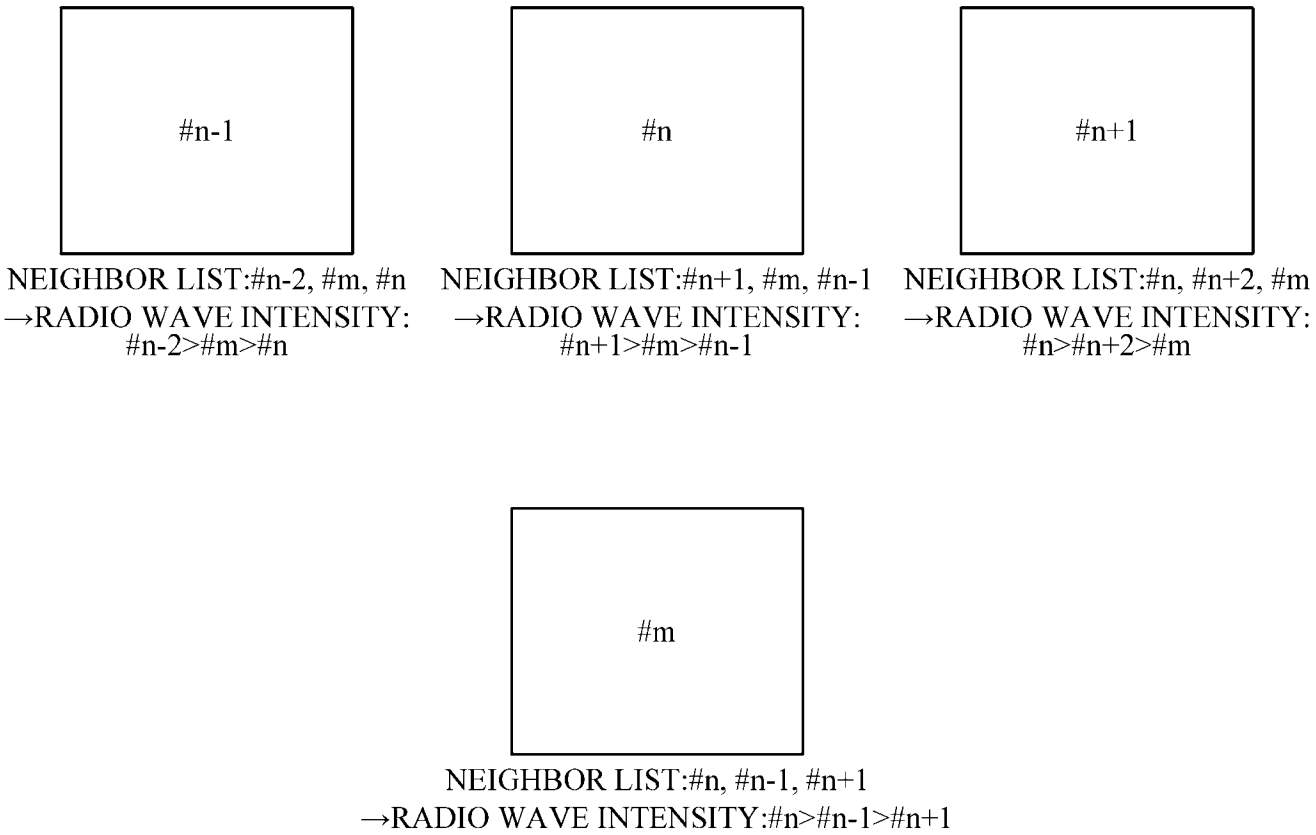
Figure 2C:
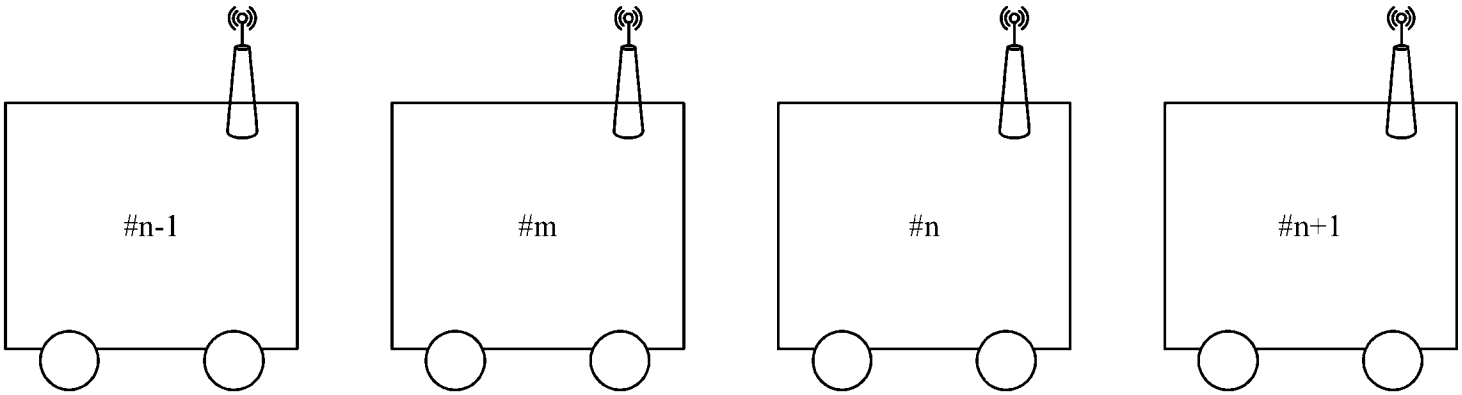

FIGS. 2A to 2C are diagrams illustrating a dynamic configuration process of an apparatus for dynamically configuring a wireless sensor relay network for monitoring train activity according to an embodiment of the present invention.

Referring to FIGS. 2A to 2C, a single train is constituted of a plurality of train cars. Here, the train cars constituting the train are not always fixed but the number of train cars of the train may be flexibly adjusted and organized depending on a corresponding traffic situation, and a specific train car may be separated and replaced for the repair of the train car.

Accordingly, when a train car is separated and/or replaced, the sensor data cannot be routed through a conventional wireless sensor relay network. Thus, in the present invention, the wireless sensor relay network may be autonomously and dynamically configured, and thereby the wireless sensor relay network may be reconfigured regardless of alternation of an arbitrary train car.

In FIG. 2A, an example in which train cars #n−1, #n, and #n+1 are organized as a train, and the train is further organized when a train car #m enters in a state in which a single wireless relay unit is installed in each of the train cars is shown. To this end, wireless relay units 201, 202, 203, and 204 of the respective train cars measure the strength of wireless signals continuously transmitted from neighbors and generate a neighbor list.

The neighbor list is generated by the wireless relay unit located in each train car. The wireless relay unit located in each train car measures the strength of the wireless signals transmitted from the neighboring wireless relay units (train cars), and generates the neighbor list. In addition, as an example, the neighbor list may be generated according to the order of radio wave intensities for three wireless relay units (train cars) having the largest strength of the wireless signals. At this point, each of the wireless relay units may be matched with a single train car at a ratio of 1:1, so that a train car in which a corresponding wireless relay unit is installed may be identified through the wireless relay unit. More specific description thereof will be additionally made with reference to FIGS. 3, 4A, and 4B which will be described below. Hereinafter, for convenience of description, the neighbor list will be described focusing on each train car.

In examples of FIGS. 2A and 2C, (a wireless relay unit of) the train car #n−1 measures the strength of wireless signals from (wireless relay units of) neighbors and generates a first neighbor list (#n−2, #m, and #n) according to the order of strength of the wireless signals.

The train car #n measures the strength of wireless signals from neighbors, and generates a second neighbor list (#n+1, #m, and #n−1) according to the order of strength of the wireless signals. Next, the train car #n+1 measures the strength of wireless signals from neighbors, and generates a third neighbor list (#n, #n+2, and #m) according to the order of strength of the wireless signals. Next, the car #m measures the strength of wireless signals from neighbors, and generates a fourth neighbor list (#n, #n−1, and #n+1) according to the order of strength of the wireless signals.

As described above, the wireless relay unit measures the strength of wireless signals from neighbors (wireless relay units), and generates a neighbor list. Next, the wireless relay unit may incorporate a newly organized train car into the wireless sensor relay network based on the neighbor list.

Next, the wireless relay unit confirms the presence of the newly added train car #m based on the generated neighbor list, and confirms the order of the train car and the location of the newly added train car #m. The wireless relay unit confirms the order of organization of the train cars including the newly added train car #m, that is, the order of connection of the wireless relay units, and dynamically configures a path for transmitting sensor data between the wireless relay units.

Figure 3:
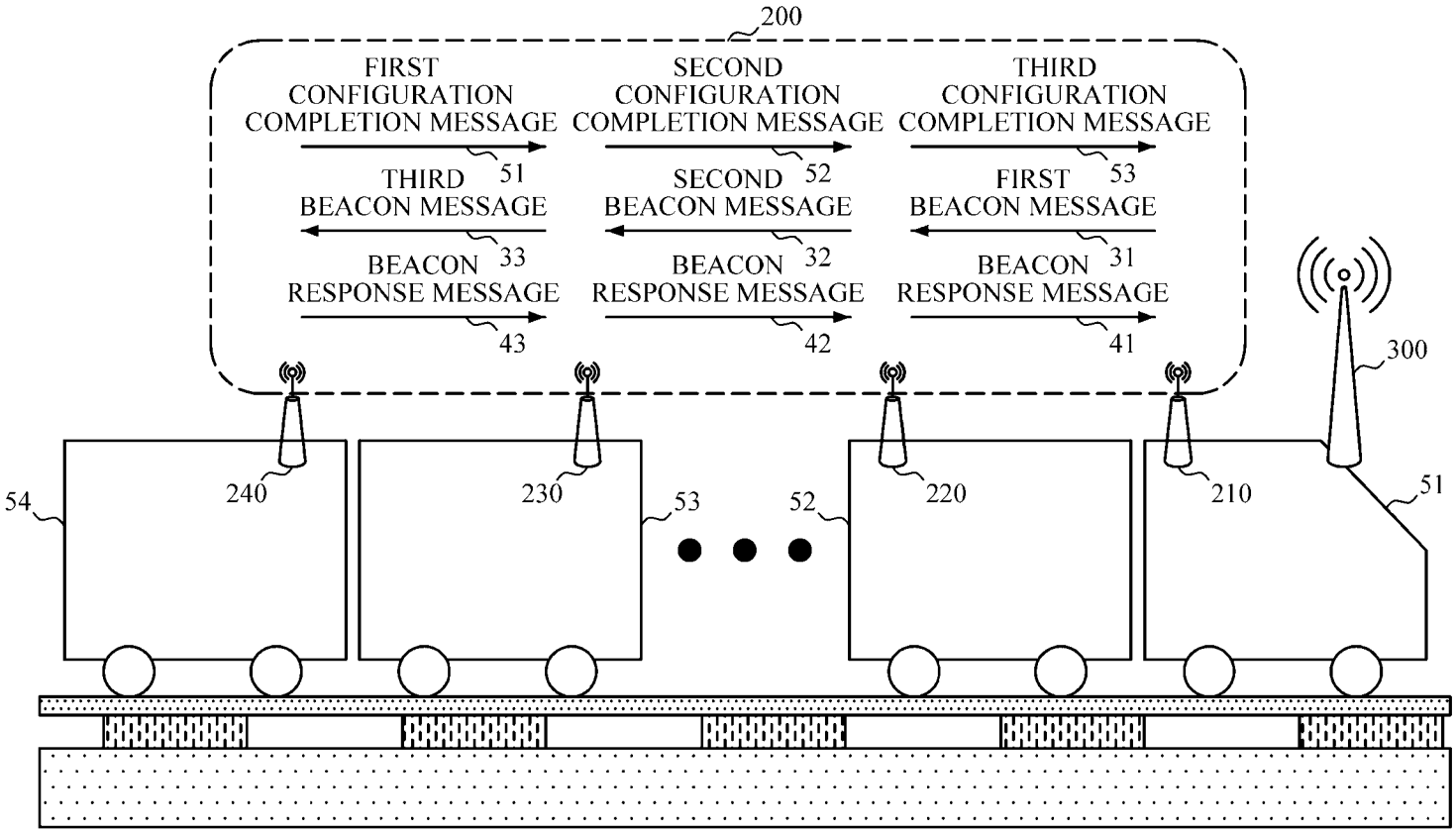
FIG. 3 is a diagram illustrating a configuration process of a wireless sensor relay network of an apparatus for dynamically configuring a wireless sensor relay network for monitoring train activity according to an embodiment of the present invention.

FIG. 3 is a diagram illustrating a configuration process of a wireless sensor relay network of an apparatus for dynamically configuring a wireless sensor relay network for monitoring train activity according to an embodiment of the present invention.

Referring to FIG. 3, in the apparatus for dynamically configuring a wireless sensor relay network for monitoring train activity according to an embodiment of the present invention, wireless relay units 210, 220, 230, and 240 establish a wireless relay network, and transmit sensor data to a gateway unit 300 via a neighboring wireless relay unit. Here, since the train cars can be flexibly organized, the wireless relay network should also be dynamically established depending on alternation of the train car. In FIGS. 2A and 2C, each of the wireless relay units generates a neighbor list based on the strength of wireless signals, and confirms the order of organization of train cars based on the generated neighbor list.

Next, a first wireless relay unit 210 (hereinafter referred to as a master wireless relay unit) of a train car 51 in which the gateway unit 300 is installed performs a process for dynamically generating a relay path through beacon signal transmission. The master wireless relay unit 210 generates a first beacon message 31, and transmits the generated first beacon message 31 to a second wireless relay unit 220 located in the following train car 52. At this point, the master wireless relay unit 210 determines the neighboring wireless relay unit 220 based on neighboring train information.

The first beacon message 31 generated in the master wireless relay unit 210 includes information such as a source car number, a car IP address, the number of wireless paths, or the like which is information about the source car 51 that generates the beacon.

The second wireless relay unit 220 adds, to the received first beacon message 31, a number and an IP address of the second car 52 which are information about the second car (a relay car) in which the second wireless relay unit 220 is located, and updates a number and IP address of a destination car and the number of wireless paths, thereby generating a second beacon message 32. Next, the second wireless relay unit 220 transmits the generated second beacon message 32 to a third wireless relay unit 230 of a neighboring car 53 based on neighboring train information, and at the same time, a beacon response message 41 to the first wireless relay unit 210 to which the first beacon message is transmitted.

The third wireless relay unit 230 adds a number and IP address of the third car 53 in which the third wireless relay unit 230 is located in the same manner as the second wireless relay unit 220, and updates destination car information and the number of wireless paths, thereby generating a third beacon message 33. Next, the third wireless relay unit 230 transmits the generated third beacon message 33 to a fourth wireless relay unit 240 of a neighboring car 54, and at the same time, transmits a beacon response message 42 to which the second beacon message is transmitted. The above-described process is repeatedly performed by the number of train cars.

The fourth wireless relay unit 240 located in the final train car 54 adds a number and IP address of the car 54 in the same manner as in the above-described process, updates the number of wireless paths to generate and transmit a new beacon message, and at the same time, transmits a beacon response message 43 to the third wireless relay unit 230 to which the third beacon message is transmitted.

At this point, in the example of FIG. 3, since the fourth wireless relay unit 240 is located in the final train car 54, the fourth wireless relay unit 240 cannot receive a beacon response message. Accordingly, when a new beacon response message is not received within a predetermined response waiting time, the fourth wireless relay unit 240 generates a configuration completion message for a wireless relay network and transmits the generated message to the third wireless relay unit 230. Next, the configuration completion message for the wireless relay network is transmitted in the reverse order (the reverse order of the train cars) of the order in which the beacon message was transmitted, and finally transmitted to the master wireless relay unit 210.

The master wireless relay unit 210 generates a wireless sensor relay network 200 based on the received third configuration completion message 53.

Figure 4A:
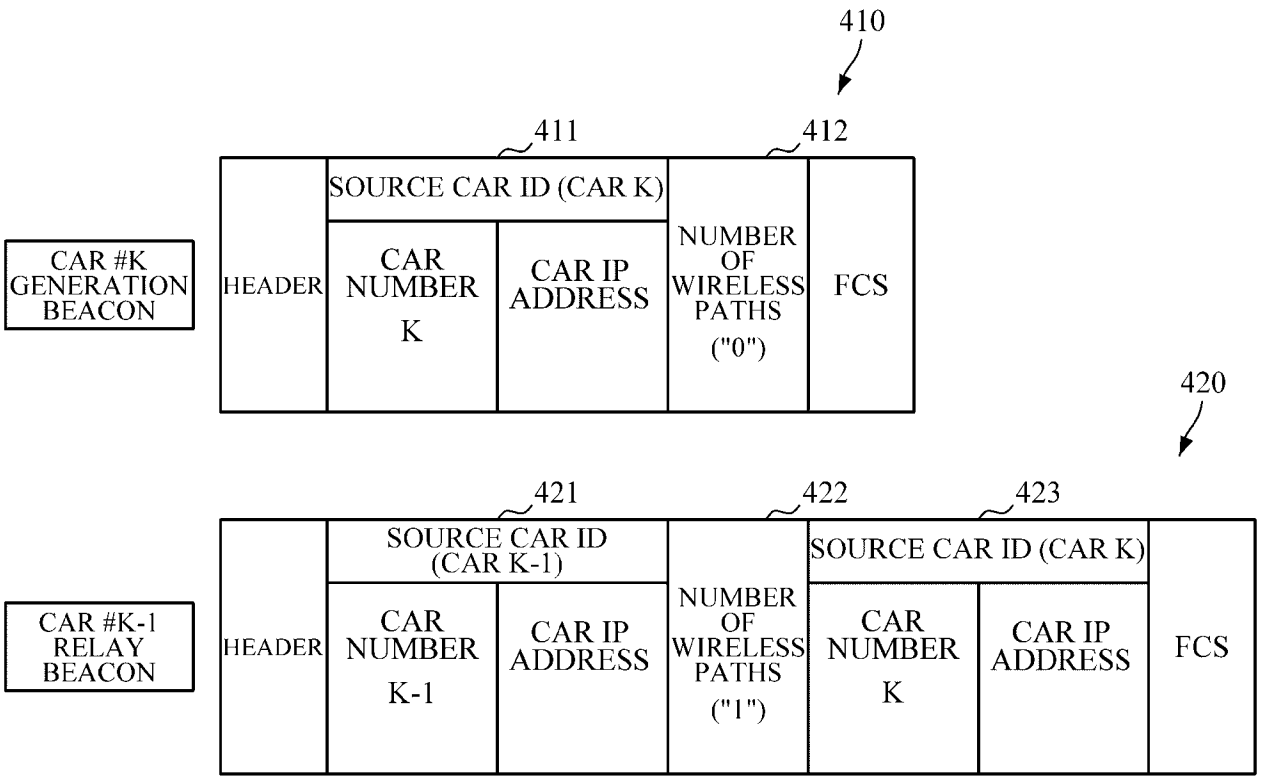
FIGS. 4A and 4B are diagrams illustrating a configuration of a beacon message of an apparatus for dynamically configuring a wireless sensor relay network for monitoring train activity according to an embodiment of the present invention.
Figure 4B:
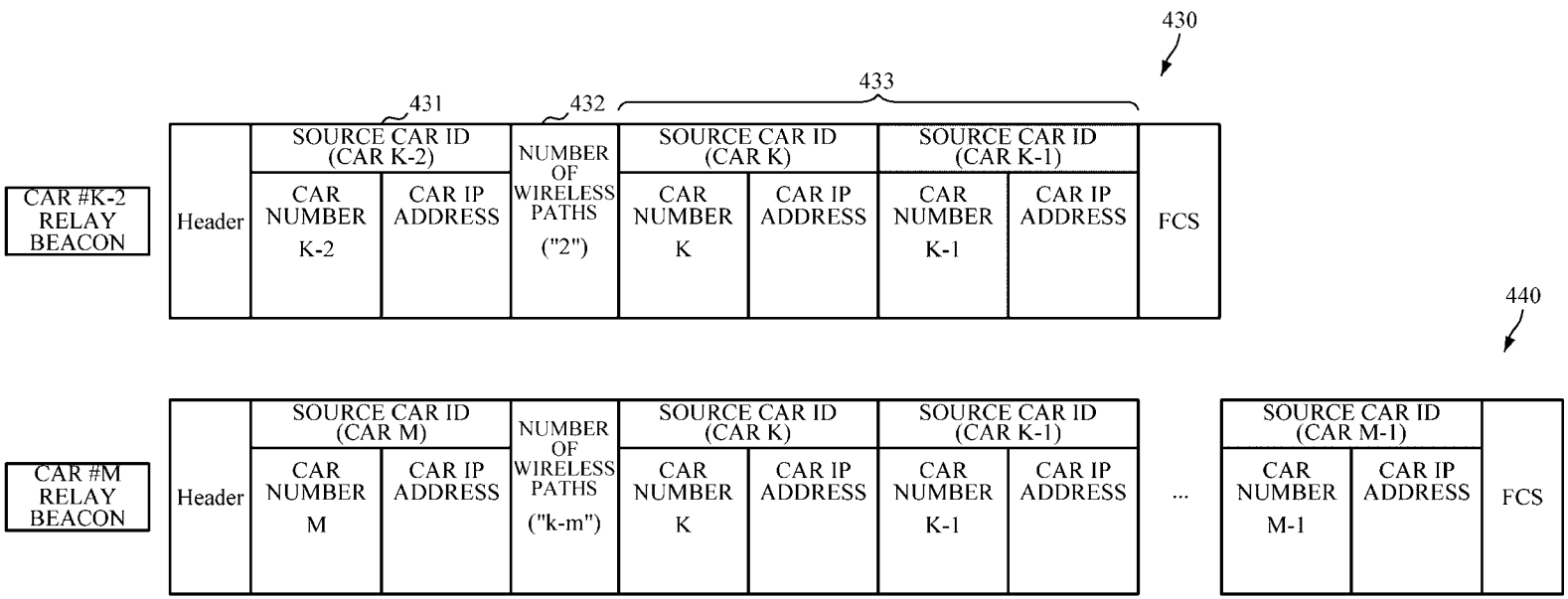

FIGS. 4A and 4B are diagrams illustrating a configuration of a beacon message of an apparatus for dynamically configuring a wireless sensor relay network for monitoring train activity according to an embodiment of the present invention.

Referring to FIGS. 4A and 4B, a beacon message sequentially transmitted according to neighbor information between wireless relay units 210, 220, 230, and 240 includes car information of a source car to which the beacon message is first transmitted and the number of wireless paths. At this point, the car information includes a source car ID, a source car number, and a source car IP address. Such a beacon message is sequentially transmitted to a neighboring wireless relay unit based on neighbor information, and each wireless relay unit updates the received beacon message to relay and transmit the updated message to a neighboring wireless relay unit.

A master wireless relay unit of a source car K generates a first beacon message. The first beacon message includes information 411 of the source car that generates a beacon and the number of wireless paths 412. The source car information is information for identifying a source car, and includes a source car number K and a source car IP address. The first beacon message includes a header and a frame check sequence (FCS). The number of wireless paths indicates the number of wireless repeaters of a path from a wireless repeater master, and the initial number of wireless paths is 0.

The wireless relay unit of the car #k determines a neighboring wireless repeater based on wireless signal strength information included in a neighbor list generated in advance, and transmits a generated first beacon message 410 to the determined wireless repeater.

A wireless relay unit of a car #k−1 that has received the first beacon message 410 from the master wireless repeater of the source car #k updates second source car information 421 of the first beacon message 420 and the number of second wireless paths 422, and adds and updates first path car information 423 to generate a second beacon message 420. The new source car information 421 is updated to information of a car #k−1 that is a new source car, and the number of wireless paths 422 is updated to 1 that is the number of paths from the initial source car #k. The path car information 423 is information of a car located on the previous path, that is, information of a wireless relay unit directly connected to the car located on the previous path. As an example, the first source car information is information about the source car #k that has transmitted the first beacon message 410.

The wireless relay unit of the car #k−1 determines a neighboring wireless repeater based on wireless signal strength information included in a neighbor list generated in advance, and transmits an updated second beacon message 420 to the determined wireless repeater. In the example of FIG. 4, a wireless repeater of a car #k−2 is determined as a neighboring wireless repeater.

Next, the wireless repeater of the car #k−2 that has received the second beacon message 420 from the car #k−1 updates source car information of the second beacon message 420, the number of wireless paths, and path car information, and generates a third beacon message 430. Updated third source car information 431 is updated to information of the car #k−2 to which the third beacon message 430 is to be transmitted, and the number of third wireless paths 432 is updated to 2 that is the number of wireless relay units through which the beacon message passes. Next, new path car information is added to third path car information 433. When the third beacon message 430 is updated, a wireless repeater of the car #k−2 determines a neighboring wireless repeater based on neighbor information, and transmits the third beacon message 430 to the determined wireless repeater. The above-described process is repeatedly performed up to an arbitrary car #m. In this process, the arbitrary car #m maintains a communication path with a path car specified in the beacon message.

Figure 5:
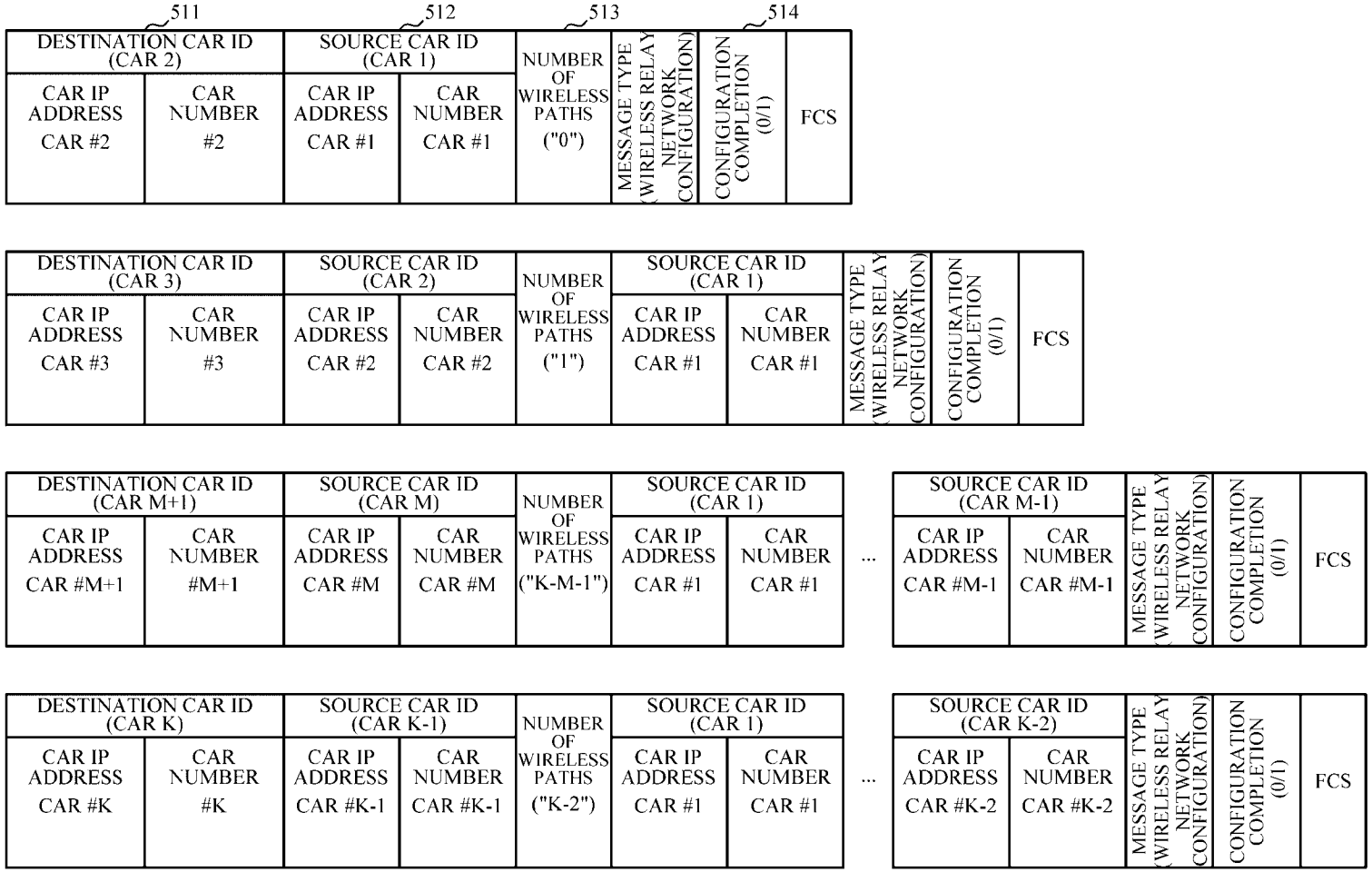
FIG. 5 is a diagram illustrating a configuration of a configuration completion message of an apparatus for dynamically configuring a wireless sensor relay network for monitoring train activity according to an embodiment of the present invention.

FIG. 5 is a diagram illustrating a configuration of a configuration completion message of an apparatus for dynamically configuring a wireless sensor relay network for monitoring train activity according to an embodiment of the present invention.

Referring to FIG. 5, when a beacon message is relayed and transmitted and then a response signal is not received by the time a predetermined waiting time has elapsed, the fourth wireless relay unit 240 of FIG. 3 generates a configuration completion message, and transmits the generated message to a third wireless relay unit 230 of a neighbor 53. The configuration completion message is generated based on the received beacon message, and includes destination car information 511, source car information 512, the number of wireless paths 513, and configuration completion information 514. In particular, a wireless relay unit of a last train car cannot receive a response message, and therefore checks whether the response message is received by driving a timer.

The wireless relay unit that has received the configuration completion message updates destination car information, source car information, and the number of wireless paths, adds and updates relay car information and re-processes the added and updated relay car information, and then transmits the re-processed information to a neighboring wireless relay unit. The configuration of the wireless sensor relay network is completed by repeatedly performing this process.

Figure 6:
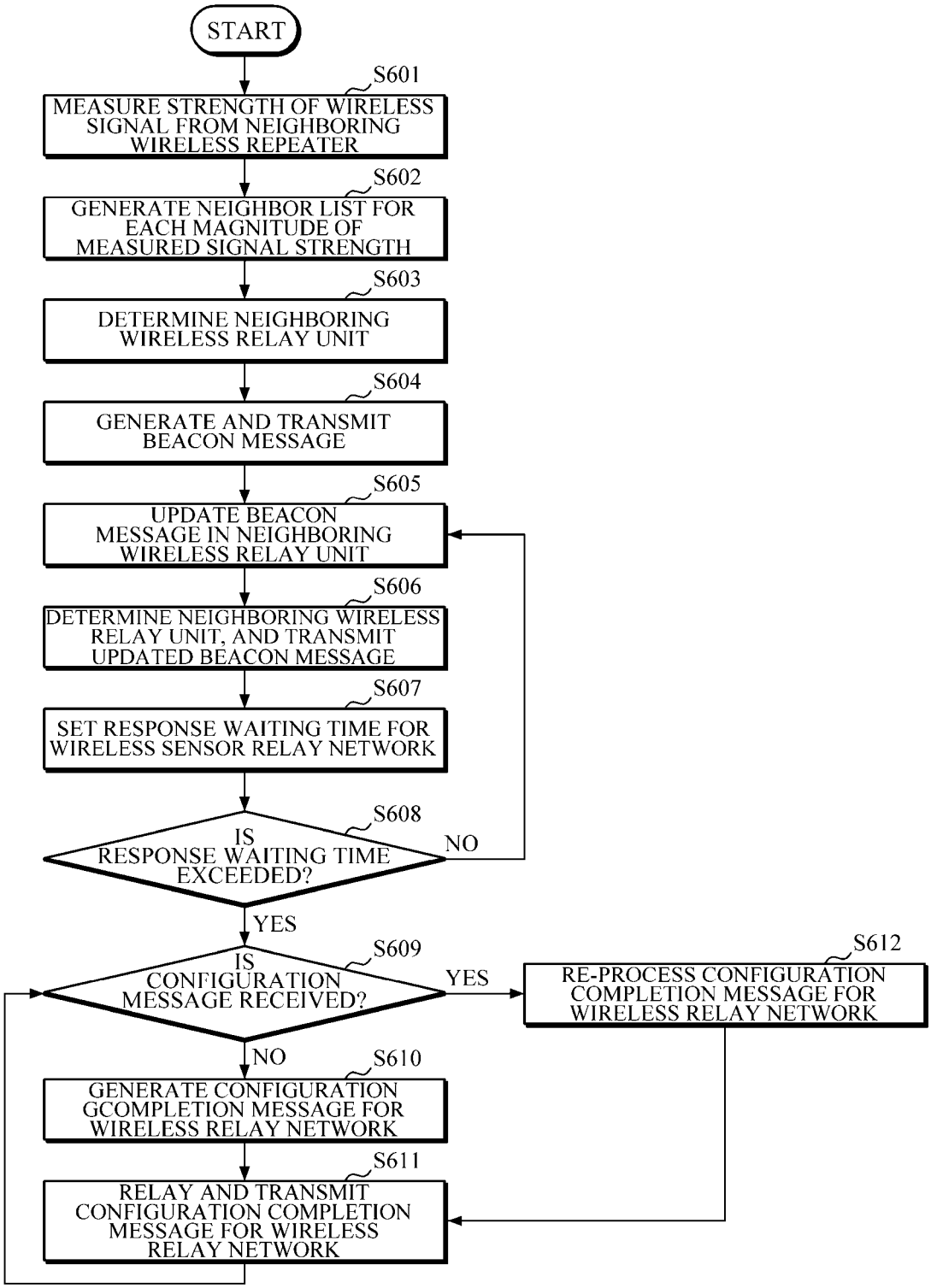
FIG. 6 is a flowchart illustrating a method for dynamically configuring a wireless sensor relay network for monitoring train activity according to an embodiment of the present invention.

FIG. 6 is a flowchart illustrating a method for dynamically configuring a wireless sensor relay network for monitoring train activity according to an embodiment of the present invention.

Referring to FIG. 6, train cars constituting a train are not always fixed but the number of train cars of the train may be flexibly adjusted and organized depending on a corresponding traffic situation, and a specific train car may be separated and replaced for the repair of the train car. Organization of a train (a freight train) may be arbitrarily changed at an arbitrary time, and a wireless link may be arbitrarily disconnected or equipment failure may occur depending on a change in a radio wave condition.

Accordingly, a method for dynamically configuring a wireless sensor relay network for monitoring train activity according to an embodiment of the present invention dynamically and periodically performs sensing data path setting to dynamically configure a wireless sensor relay network regardless of free operation of train cars.

First, in operation S601, wireless relay units located in each of a plurality of train cars measure the strength of wireless signals from neighboring wireless repeaters. Next, in operation S602, each wireless relay unit generates a neighbor list through the measured strength of wireless signals from wireless relay units of neighbors. As an example, the neighbor list may be generated according to the order of radio wave intensities for three wireless relay units (train cars) having the largest strength of the wireless signals. In this manner, the wireless relay unit may measure the strength of wireless signals of the neighboring wireless relay units and generate the neighbor list, and thereby may confirm the presence of a newly added train car (a wireless relay unit), and confirm the neighboring wireless relay unit and the order of connection thereof.

Next, in operation S603, a master wireless relay unit located at the same train car as a gateway unit determines a neighboring wireless relay unit based on the generated neighbor list. Next, in operation S604, the master wireless relay unit generates a beacon message, and transmits the generated beacon message to the determined neighboring wireless relay unit. The beacon message generated by the master wireless relay unit includes source car information of a source car that generates a beacon and the number of wireless paths. The source car information includes a source car number and a car IP address.

In operation S605, the wireless relay unit that has received the beacon message updates and re-processes the received beacon message. The neighboring wireless relay unit updates the source car information and the number of wireless paths of the received beacon message, and generates a beacon message updated by adding path car information. At this point, the path car information is information about the wireless relay unit through which the beacon message passes. That is, the source car information of the received beacon message is added as new path car information, and a train car in which the wireless relay unit that has received the beacon message is located is updated to source car information.

In operation S606, when the beacon message is updated, the wireless relay unit determines a neighboring wireless relay unit based on the neighbor list, and transmits the updated beacon message to the determined wireless relay unit.

Next, the wireless relay unit sets a response waiting time in operation S607 after transmitting the updated beacon message to a neighboring wireless relay unit, and determines whether the wireless relay unit exceeds the response waiting time in operation S608 by determining whether a response message is received within the response waiting time. The wireless relay unit that has received the beacon message transmits a response to this. When the response signal is received within the response waiting time set in advance and the wireless relay unit does not exceed the response waiting time, it is determined that the neighboring wireless relay unit has received the beacon message normally, operations S605 to S608 are sequentially performed repeatedly between the neighboring wireless relay units.

In operation S609, when the wireless relay unit exceeds the response waiting time set in advance, the wireless relay unit determines whether a configuration completion message is received. When the wireless relay unit exceeds the response waiting time, this means that the neighboring wireless relay unit has not received the beacon message normally, and it may be determined that there is no following wireless relay unit and the current wireless relay unit is located in the last train car.

When the configuration completion message is not received, the wireless relay unit that exceeds the response waiting time generates the configuration completion message for the wireless relay network in operation S610, and relays and transmits the configuration completion message for the wireless relay network in operation S611. Next, the wireless relay unit that has received the configuration completion message updates and re-processes the received configuration completion message in operation S612, and relays and transmits the re-processed configuration completion message in operation S611. That is, the configuration completion message for the wireless relay network is updated, relayed, and transmitted in the reverse order of the order in which the beacon message is transmitted from the wireless relay unit located at the last train car which exceeds the response waiting time, and the transmitted configuration completion message is transmitted to a master wireless relay unit located at the head of the train cars to generate a wireless sensor relay network.

Figure 7:
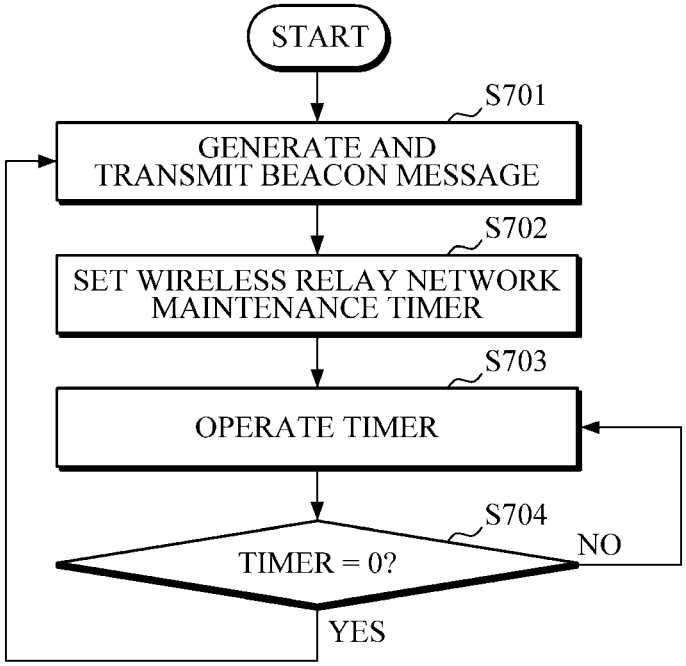
FIG. 7 is a flowchart illustrating a setting procedure of a master wireless relay unit of a method for dynamically configuring a wireless sensor relay network for monitoring train activity according to an embodiment of the present invention.

FIG. 7 is a flowchart illustrating a setting procedure of a master wireless relay unit of a method for dynamically configuring a wireless sensor relay network for monitoring train activity according to an embodiment of the present invention.

Organization of a train (a freight train) may be arbitrarily changed at an arbitrary time, and a wireless link may be arbitrarily disconnected or equipment failure may occur depending on a change in a radio wave condition. Accordingly, it is necessary to dynamically and periodically perform sensing data path setting.

Referring to FIG. 7, in a method for dynamically configuring a wireless sensor relay network for monitoring train activity according to an embodiment of the present invention, a master wireless relay unit generates a beacon message for establishing a wireless sensor relay network as described in FIGS. 1 to 3, and transmits the generated beacon message to a neighboring wireless relay unit in operation S701. Next, the master wireless relay unit sets a wireless relay network maintenance timer in operation S702. Next, the master wireless relay unit reduces a timer value by operating the wireless relay network maintenance timer in operation 703, and repeatedly performs an operation of generating and transmitting a beacon message for configuring a new wireless relay network when the timer is terminated in operation S704.

As described above, according to the apparatus and method for dynamically configuring a wireless sensor relay network for monitoring train activity, a wireless sensor may be mounted on a running unit of a train car to acquire an operating state in real-time and transmit the acquired operating state to a control center, thereby securing the safe operation of the train car.

According to the apparatus and method for dynamically configuring a wireless sensor relay network for monitoring train activity, a wireless sensor relay network may be autonomously configured with respect to a train in which arbitrary train cars are organized, thereby managing the train operation irrespective of the configuration of the train cars.

According to the apparatus and method for dynamically configuring a wireless sensor relay network for monitoring train activity, a service area of a low-power wireless sensor network having limited transmission capacity may be enlarged by using a wireless relay unit, thereby securing real-time monitoring technology for a train.

The present invention including the above-described content may be written as a computer program. Furthermore, codes and code segments constituting the computer program can be easily inferred by a skilled computer programmer in the art. Furthermore, the written program may be stored in a computer-readable recording medium or an information storage medium, and a computer may read and execute the program to implement the method in accordance with the embodiment of the present invention. The recording medium includes all types of computer-readable recording media.

While the present invention has been described with respect to the specific embodiments, it will be apparent to those skilled in the art that various changes and modifications may be made without departing from the spirit and scope of the invention as defined in the following claims.

What is claimed is:

1. An apparatus for dynamically configuring a wireless sensor relay network for monitoring train activity, comprising:

a plurality of wireless sensors that wirelessly transmit sensor data obtained by measuring heat and vibration of a train running unit;

a plurality of coordinator units that are located in train cars and receive the sensor data from one or more wireless sensors located within the same train car;

a plurality of wireless relay units that are located in the train cars, form a wireless sensor relay network with the wireless relay unit located in a neighboring train car, and transmit the sensor data received from the coordinator units; and a gateway unit that receives the sensor data from the plurality of wireless relay units through the wireless sensor relay network, and transmits the received sensor data to a control center, wherein the plurality of wireless relay units measure strength of wireless signals from neighboring wireless relay units and generate a neighbor list.

2. The apparatus for dynamically configuring a wireless sensor relay network for monitoring train activity according to claim 1, wherein the wireless relay unit located at the same train car as the gateway unit among the plurality of wireless relay units generates a beacon message, determines a neighboring wireless relay unit based on the neighbor list, and transmits the generated beacon message to the determined neighboring wireless relay unit.

3. The apparatus for dynamically configuring a wireless sensor relay network for monitoring train activity according to claim 2, wherein the beacon message includes source car information and information about the number of wireless paths.

4. The apparatus for dynamically configuring a wireless sensor relay network for monitoring train activity according to claim 2, wherein the plurality of wireless relay units update the received beacon message, and relay and transmit the updated beacon message to the neighboring wireless relay units.

5. The apparatus for dynamically configuring a wireless sensor relay network for monitoring train activity according to claim 4, wherein the updated beacon message includes source car information, the number of wireless paths, and path car information.

6. The apparatus for dynamically configuring a wireless sensor relay network for monitoring train activity according to claim 2, wherein the wireless relay unit that has received the beacon message updates source car information to information of the wireless relay unit itself, adds and updates the number of wireless paths, and adds and updates another wireless relay unit connected directly to the wireless relay unit itself to path car information.

7. The apparatus for dynamically configuring a wireless sensor relay network for monitoring train activity according to claim 2, wherein a wireless relay unit that fails to receive a response to the transmitted beacon message within a predetermined response waiting time among the plurality of wireless relay units generates a configuration completion message, and transmits the generated configuration completion message to the previous wireless relay unit.

8. The apparatus for dynamically configuring a wireless sensor relay network for monitoring train activity according to claim 7, wherein the plurality of wireless relay units update destination car information of the received configuration completion message, source car information, and information about the number of wireless paths, and transmit the updated information to the previous wireless relay unit.

9. The apparatus for dynamically configuring a wireless sensor relay network for monitoring train activity according to claim 1, wherein the plurality of wireless relay units incorporate a newly organized train car into the wireless sensor relay network based on the neighbor list.

10. The apparatus for dynamically configuring a wireless sensor relay network for monitoring train activity according to claim 1, wherein the gateway unit transmits the sensor data to the control center using a broadband wireless communication network.

11. The apparatus for dynamically configuring a wireless sensor relay network for monitoring train activity according to claim 1, wherein the plurality of wireless sensors and the plurality of coordinator units are wirelessly connected through Zigbee communication.

12. A method for dynamically configuring a wireless sensor relay network using an apparatus for dynamically configuring the wireless sensor relay network for monitoring train activity, the method comprising:

measuring, by each of a plurality of wireless relay units that are located in train cars, strength of wireless signals from neighboring wireless relay units, and generating a neighbor list;

generating, by the wireless relay unit located at the same train car with a gateway unit among the plurality of wireless relay units, a beacon message, and transmitting the generated beacon message to a neighboring wireless relay unit;

updating, by the plurality of wireless relay units, the received beacon message, and sequentially relaying and transmitting the updated beacon message to the neighboring wireless relay unit;

generating, by the plurality of wireless relay units, a configuration completion message when a predetermined response waiting time is exceeded, and transmitting the generated configuration completion message to the previous wireless relay unit; and receiving, by the wireless relay unit located at the same train car with the gateway unit among the plurality of wireless relay units, the configuration completion message, and generating the wireless sensor relay network.

13. The method according to claim 12, wherein the beacon message includes source car information and information about the number of wireless paths.

14. The method according to claim 12, wherein the updating of the received beacon message includes updating source car information to information of the wireless relay unit itself, adding and updating the number of wireless paths, and adding and updating another wireless relay unit connected directly to the wireless relay unit itself to path car information.

15. The method according to claim 12, further comprising:

setting, by the wireless relay unit located at the same train car with a gateway unit among the plurality of wireless relay units, a response waiting time for the wireless sensor relay network.

16. The method according to claim 12, wherein the generating of the configuration completion message includes updating destination car information of the received configuration completion message, source car information, and information about the number of wireless paths, and transmitting the updated information to the previous wireless relay unit.

17. The method according to claim 12, wherein the plurality of wireless relay units incorporate a newly organized train car into the wireless sensor relay network based on the neighbor list.

* * * * *